United States Patent [19]

Leimkühler et al.

[11] Patent Number: 4,768,748

[45] Date of Patent: Sep. 6, 1988

[54] FORMWORK WITH MAGNETIC DEVICES FOR SEPARABLY COUPLING ITS FORMS

[75] Inventors: Herbert Leimkühler, Versmold; Barbara R. Brost, Appenweier, both of Fed. Rep. of Germany

[73] Assignee: Josef Maier, Steinach, Fed. Rep. of Germany

[21] Appl. No.: 38,841

[22] Filed: Apr. 15, 1987

[30] Foreign Application Priority Data

Apr. 16, 1986 [DE] Fed. Rep. of Germany ..... 3612742

[51] Int. Cl.[4] ..... E04G 9/08; E04G 17/04

[52] U.S. Cl. ..... 249/192; 249/47; 425/3

[58] Field of Search ..... 249/13, 33, 93, 167, 249/189, 191, 192, 193, 194, 219 R, 47, 168; 425/3

[56] References Cited

U.S. PATENT DOCUMENTS 2,845,685 8/1958 Lovgren et al. ..... 249/192

FOREIGN PATENT DOCUMENTS 3117842 12/1982 Fed. Rep. of Germany ..... 425/3
2538049 6/1984 France ..... 249/219 R
476991 10/1975 U.S.S.R. ..... 425/3

*Primary Examiner*—Jay H. Woo
*Assistant Examiner*—James C. Housel
*Attorney, Agent, or Firm*—Peter K. Kontler

[57] ABSTRACT

A formwork wherein the marginal portions of neighboring forms are attracted to each other by magnets. The rear sides of the forms can carry additional magnets for attachment of braces, beams, rods and like parts. The magnets can be assisted by mechanical coupling elements in the form of tongues and grooves, bolts, hooks, bolts and nuts or like parts. Each magnet can be recessed into the marginal portion of the respective form or is separably secured thereto by one or more elastic clips or the like.

18 Claims, 2 Drawing Sheets

FORMWORK WITH MAGNETIC DEVICES FOR SEPARABLY COUPLING ITS FORMS

BACKGROUND OF THE INVENTION

The present invention relates to formworks in general, and more particularly to improvements in devices for separably coupling the forms of a formwork to each other.

Commonly owned German Pat. No. 21 37 505 discloses a formwork wherein the marginal portions of panel-like forms are separably coupled to each other by bolts which fit into keyhole-like openings in the forms. Another commonly owned German Pat. No. 22 03 999 discloses a formwork wherein the marginal portions of the forms carry rails which are affixed thereto by bolts of the type disclosed in Pat. No. 21 37 505 and serve to flank a compensating panel or to carry a set of reinforcing beams. A further commonly owned German Pat. No. 22 01 050 discloses an arrangement for securing beams to the rear sides of forms in a formwork. The arrangement comprises pivotable brackets which engage the beams and bias them against the formwork under the action of slotted links which are movably affixed to the rear sides of forms and cooperate with wedges. Each of these patents discloses coupling devices which do not yield when the formwork is in use, i.e., when the front sides of its forms are in contact with a cement wall or the like. Moreover, each of the patented coupling devices employs male coupling elements in the form of bolts, wedges or like parts which must fit snugly into complementary holes, slots or bores in order to ensure reliable retention of the forms in their desired positions. This presents problems when the forms are deformed or soiled so that it is necessary to resort to hammers and/or other tools in order to assemble the forms into a formwork or to dismantle an assembled formwork. The operation with tools prolongs the interval of time which is required for assembly or dismantling.

OBJECTS AND SUMMARY OF THE INVENTION

An object of the invention is to provide a formwork wherein the forms can be assembled with or separated from each other in a simple, efficient and time-saving manner.

Another object of the invention is to provide novel and improved devices for separably coupling the marginal portions of neighboring forms to each other.

A further object of the invention is to provide a formwork which embodies the forms with improved coupling devices for their marginal portions.

An additional object of the invention is to provide a formwork wherein the couplings between the marginal portions of neighboring forms can give when the need arises, e.g., to avoid excessive stressing of the assembled formwork.

Still another object of the invention is to provide a formwork wherein the forms can be assembled with each other or separated from one another within a fraction of time which is required in accordance with heretofore known proposals.

An additional object of the invention is to provide a novel method of coupling the forms of a formwork for concrete or like materials to each other.

A further object of the invention is to provide a formwork wherein the forms can be coupled to each other with a force which can be varied within a desired range and wherein minor or even extensive deformation of forms does not adversely affect the facility and/or the speed of assembling or dismantling the formwork.

Another object of the invention is to provide a formwork whose forms need not be weakened by numerous holes, bores, slots, recesses and the like.

A further object of the invention is to provide coupling devices which allow for reliable retention of forms in selected positions during assembly of forms into a formwork.

The improved formwork comprises at least two forms (normally in the form of panels or plates) which have neighboring elongated marginal portions, and novel and improved means for separably coupling the marginal portions to each other. In accordance with a feature of the invention, the coupling means includes magnets which are preferably designed to perform at least a substantial part, most preferably the major part, of the coupling action. The coupling means can further comprise interfitted male and female detent means, such as tongue and groove connections, which are provided on the marginal portions. The arrangement may be such that the detent means serve to oppose movements of the forms relative to each other in the longitudinal direction of the marginal portions and the magnets serve to oppose movements of the marginal portions away from each other (in addition, the magnets can oppose and normally do oppose relative movements of the forms in the longitudinal direction of the marginal portions).

The coupling means preferably further comprises means for mechanically fastening the marginal portions of the forms to each other. To this end, at least one of the marginal portions can be provided with holes, bores, hooks, pawls or other types of female or male fastening means to ensure that, if necessary, the two marginal portions can be more or less positively locked to each other.

The magnets can be recessed in at least one of the marginal portions. Clips or other suitable means can be provided for separably connecting the magnets to the respective marginal portion or portions. The arrangement may be such that the magnets include a first set of magnets having a first polarity and being permanently or separably mounted on or in one of the marginal portions, and a second set of magnets having a different second polarity and being permanently or separably mounted in or on the other marginal portion so as to attract the magnets of the first set. Alternatively, magnets having a desired polarity can be provided on one of the marginal portions and the other marginal portion can include or constitute a ferromagnetic component or a set of ferromagnetic components which are attracted by the magnets in or on the one marginal portion. The magnets can form integral parts of the respective marginal portion(s), and the same applies for the ferromagnetic component or components.

For example, one of the marginal portions can constitute a straight elongated ferromagnetic part which is attracted by a set of magnets recessed into the other marginal portion.

It is further within the purview of the invention to provide the rear sides of the forms (i.e., those sides which face away from concrete when the formwork is in use) with one or more additional or auxiliary magnets which can be used to separably attract beams, brackets, braces and like parts which are to be separably connected to a form in order to enhance the stability of the assembled formwork and/or for other purposes.

The novel features which are considered as characteristic of the invention are set forth in particular in the appended claims. The improved formwork itself, however, both as to its construction and the mode of assembling the same, together with additional features and advantages thereof, will be best understood upon perusal of the following detailed description of certain specific embodiments with reference to the accompanying drawing.

DESCRIPTION OF THE PREFERRED EMBODIMENTS

Figure 3:
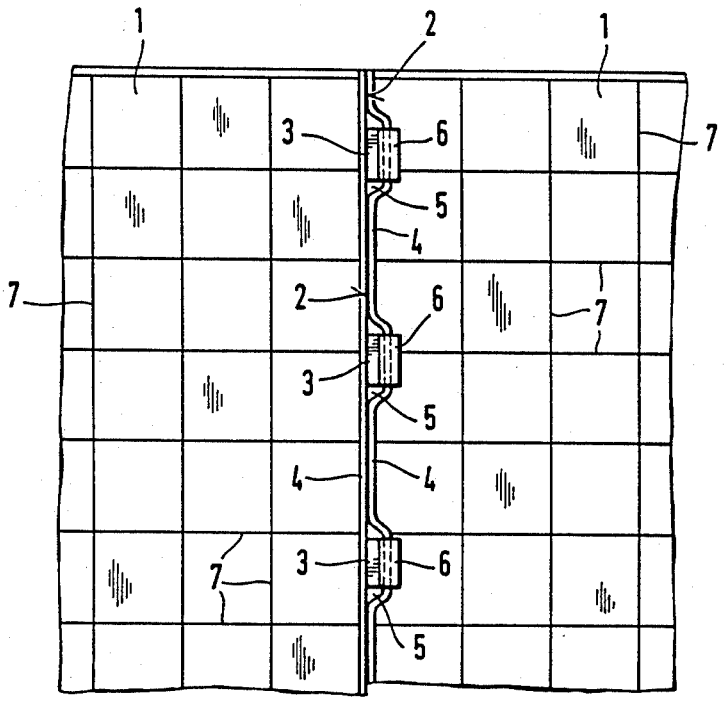
FIG. 3 is a fragmentary rear elevational view of a formwork whose forms are separably coupled to each other in accordance with a third embodiment of the invention.

Referring first to FIG. 3, there is shown a portion of an assembled formwork including two neighboring forms 1 each of which constitutes a rather large panel made of sheet metal, wood, plastic or other suitable material. The abuting elongated vertical marginal portions of the panels 1 (such marginal portions include metallic or plastic linings 2) are separably coupled to each other in accordance with the present invention, namely by utilizing at least one set of magnets, e.g., permanent magnets 3. FIG. 3 shows the rear sides of the forms 1, i.e., those sides which face away from a concrete wall or the like when the latter is contacted by the other (front) side of the assembled framework.

Figure 1:
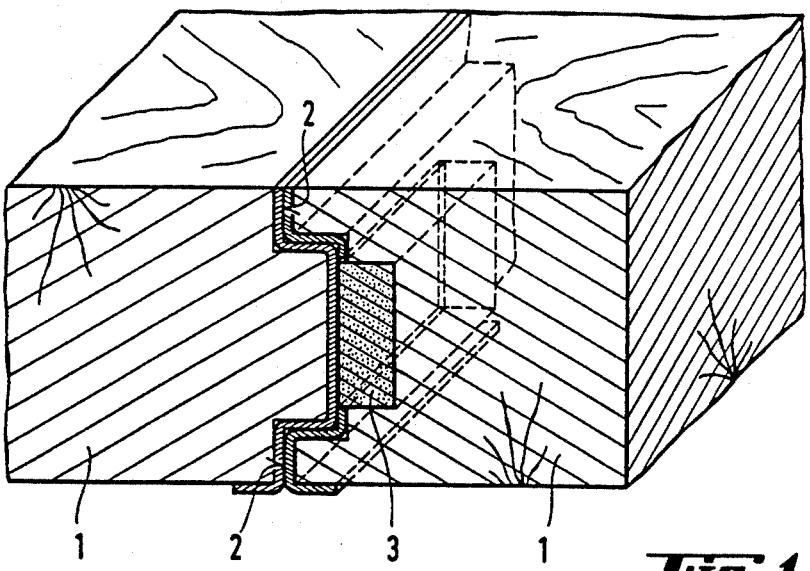
FIG. 1 is a fragmentary perspective view of portions of two forms whose marginal portions are separably coupled to each other in accordance with one embodiment of the invention.

FIG. 1 shows a first coupling device which can be employed to separably secure the linings 2 of the marginal portions of two neighboring panel-shaped forms 1 to each other. The lining 2 of the left-hand marginal portion has transversely extending male detent means in the form of tongues which fit into complementary female detent means or grooves of the lining 2 forming part of the right-hand marginal portion so that the tongues and grooves prevent a movement of the forms 1 relative to each other in the longitudinal direction of their marginal portions, i.e., up or down as seen in FIG. 1. At least the left-hand lining 2 of FIG. 2 consists of or contains a ferromagnetic material and is attracted by a set of permanent magnets 3 which are recessed into the right-hand panel 1 and extend into windows in the female detent means of the respective lining 2. The number of magnets 3 in the marginal portion of a form 1 will depend on the dimensions of the magnets, on the forces which the magnets can exert to attract the neighboring left-hand marginal portion, on the dimensions of the forms 1 and on the desired force with which the forms 1 of an assembled formwork are to be held against separation of their marginal portions. The magnets 3 cooperate with the left-hand lining 2 to normally hold the forms 1 against movement away from each other, i.e., against separation of the marginal portions of these forms. Of course, the magnets 3 further cooperate with the left-hand lining 2 to assist the tongues and grooves in holding the marginal portions against movement in the longitudinal direction of the abutting linings 2. It will be noted that the magnet 3 of FIG. 1 is recessed into the material of the respective (right-hand) form 1 immediately adjacent a window in the respective lining 2. It is not always necessary to provide tongues and grooves or analogous mechanical coupling devices all the way between the upper and lower ends of the forms 1, and the same holds true for the distribution of magnets 3. In addition, a set of magnets can be installed in the marginal portion of the left-hand form 1 of FIG. 1 to attract the right-hand lining 2.

Figure 2:
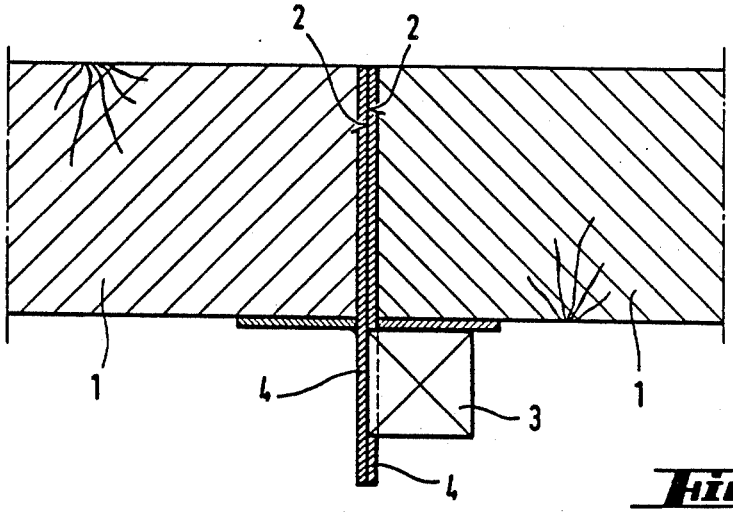
FIG. 2 is a horizontal sectional view of two forms whose marginal portions are coupled to each other in a different way.

FIG. 2 is a fragmentary horizontal sectional view of a formwork wherein the marginal portion of the right-hand form 1 carries a set or row of magnets 3 (only one shown) which are located at the rear sides of the forms. To this end, the left-hand lining 2 has an extension 4 which is adjacent the rear side of the left-hand form 1 and consists of or contains a ferromagnetic material. The illustrated magnet 3 is mounted on the marginal portion of the right-hand form 1 so that its leftmost portion extends into a window in the extension 4 of the right-hand lining 2. The magnet 3 attracts the left-hand extension 4 and thus ensures that the forms 1 are coupled to each other but can be readily separated if the need arises. The coupling means of FIG. 2 exhibits the advantage that the right-hand lining 2 need not be weakened by a row of windows in the region between the front and rear sides of the forms 1 and also that the extensions 4 of the linings 2 provide a desirable reinforcing or stiffening action. Those portions of the linings 2 which are disposed between the front and rear sides of the forms 1 can be configurated in a manner as shown in FIG. 1, i.e., they can form tongue and groove connections (not specifically shown) or analogous detent means including male and female detent elements which hold the forms 1 against movement in the longitudinal direction of their marginal portions.

The force with which magnets which are mounted in a manner as shown in FIG. 2 attract the respective marginal portions to each other is not as large as the force which can be applied by magnets which are mounted in a manner as shown in FIG. 1 (between the front and rear sides of the forms 1). However, magnets which are mounted in a manner as shown in FIG. 2 can be applied to existing forms at a low cost because many forms are already provided with reinforcing means in the form of ribs or chords of the type shown in FIG. 2 and including the linings 2 and extensions 4.

FIG. 3 shows a set of three aligned magnets 3 which are separably affixed to the marginal portion of the right-hand form by mechanical fastening means in the form of elastic clips 6 (one shown on a larger scale in FIG. 4) in such a way that each magnet is received in a recess 5 of the right-hand lining 2. This renders it possible to employ a straight left-hand lining 2 which is made of a ferromagnetic material and is attracted by the recessed magnets 3 (these magnets need not project beyond their recesses 5 in the corresponding lining 2 so that they enable the two linings to actually abut one another as shown in FIG. 3. The operators can select the number of magnets 3 which are to attract the left-hand lining 2 with a desired force. The clips 6 can be replaced with bolts and nuts or with other fastening means without departing from the spirit of the invention. Furthermore, and as shown in FIG. 1, the magnets 3 can be permanently installed in the marginal portion of the right-hand form 1.

In each embodiment of the improved formwork, the coupling action of the magnets 3 can be assisted by mechanical coupling elements in the form of hooks, pawls, bolts and nuts or the like so as to establish a magnetic as well as a separable mechanical connection between the neighboring marginal portions. For example, and if the linings 2 have extensions 4 of the type shown in FIGS. 2 to 4, those portions of the extensions which are disposed between neighboring magnets 3 can be mechanically connected to each other by bolts and nuts (not specifically shown), by hooks which are pivoted to one of the extension 4 and can enter eyelets of the other extension, or by any other mechanical fasteners which are suitable for such purposes and can be manipulated by hand with little loss in time to either couple the forms 1 to each other or to permit their separation as soon as the resistance of the magnets is overcome. The mechanical coupling elements can be provided on reinforcing ribs, webs or like parts 7 at the rear sides of the forms 1. Thus, the reinforcing ribs 7 can perform their customary functions as well as the functions of supporting or cooperating with mechanical coupling elements for the forms 1.

All illustrated embodiments of the improved coupling means for the marginal portions of neighboring forms 1 share the feature that they employ one or more sets of magnets which cooperate with magnets of opposite polarity or with ferromagnetic components to attract the marginal portions to each other. For example, the formwork of FIG. 3 can be modified by providing the left-hand lining 2 with recesses 5 which alternate with recesses 5 in the right-hand lining 2 and receive removable magnets held therein by clips 6 or by otherwise configurated mechanical fastener means (or which are permanently installed in the marginal portion of the left-hand form 1). At least those portions of the right-hand lining 2 of FIG. 3 which face the magnets in the recesses of the left-hand lining 2 are then made of a ferromagnetic material so that they are attracted by the left-hand set of magnets. Alternatively, the marginal portion of the left-hand form 1 of FIG. 3 can carry a set of magnets each of which is disposed opposite a magnet 3 in the right-hand marginal portion and each of which has an opposite polarity so that the magnets of the two sets attract each other.

Figure 4:
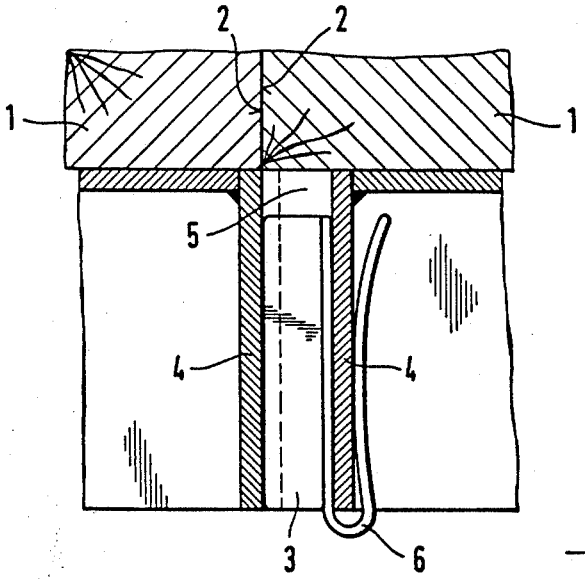
FIG. 4 is an enlarged fragmentary horizontal sectional view of the formwork of FIG. 3, showing the manner in which one of the magnets is separably held in a recess of the respective marginal portion by an elastic clip.

It is also possible to replace discrete magnets with a magnet which constitutes one of the linings 2 and to make the other lining 2 of a ferromagnetic material which is attracted by the magnet. This feature can be embodied in a manner as shown in FIG. 1, i.e., between the front and rear sides of the forms 1, or in a manner as shown in FIGS. 2 to 4, namely at the rear sides of the forms. Still further, it is possible to employ a first lining which constitutes a magnet of first polarity and a second lining which constitutes a magnet of opposite polarity. These magnets attract each other to hold the forms 1 against uncontrolled separation from each other.

FIG. 3 further shows that the rear sides of the forms 1 have grids of reinforcing or stiffening ribs or like parts 7 which enhance the stability of the respective forms as well as of the entire assembled formwork. If desired, some or all of the reinforcing parts 7 can carry additional (separable or permanently affixed) magnets 3 or otherwise configurated magnets (not specifically shown) so that the additional magnets facilitate attachment of braces, beams, brackets or other parts which are used to further reinforce the respective form or forms 1 and/or to serve other purposes. Such auxiliary parts then carry magnets of opposite polarity or ferromagnetic components so that they can cooperate with magnets on the reinforcing parts 7 of the respective form or forms 1. The connections between such auxiliary parts and the reinforcing parts 7 can be strengthened by using bolts and nuts, hooks, bolts and keyhole shaped openings and/or similar fasteners in addition to the magnets on the reinforcing parts 7. These reinforcing parts can be made of a ferromagnetic material (or can include ferromagnetic portions) to be attracted by magnets on the auxiliary parts in the form of brackets, braces, beams, rods or the like. The number and the dimensions of mechanical fasteners on the reinforcing parts 7 and/or on the extensions 4 of the linings 2 shown in FIG. 3 will depend on the desired magnitude of forces which should oppose separation of auxiliary parts from the forms and separation of the forms from one another.

The illustrated magnets 3 or analogous magnets not only serve to attract neighboring marginal portions to each other when the formwork is fully assembled but they also facilitate assembly of the formwork because they can maintain the marginal portions in selected positions during application of additional hardware such as the aforementioned bolts and nuts, hooks and the like. This contributes to a reduction of assembling time and facilitates the assembly work because the magnets can reliably hold the marginal portions in selected positions as long as necessary. As mentioned above, the magnets can be used alone, i.e., either with magnets of opposite polarity or with ferromagnetic components, or the magnets can constitute only a part of the coupling means which then further includes means for mechanically securing or fastening the marginal portions to one another. It is also possible to employ mechanical connectors in the form of clamps and the like. The selection of mechanical connector means will depend on the required strength of the assembled formwork, i.e., on the resistance which the forms should exhibit to partial or complete separation; such mechanical connector means assist magnetic forces in maintaining the neighboring marginal portions of two, three or more forms in requisite positions. Therefore, and since the mechanical connectors are intended to or can serve primarily to assist the coupling action of magnets, there is no need for a large number of mechanical connectors (i.e., the number and the retaining force of mechanical connectors need not match that of connectors which are used in formworks which are devoid of magnetic coupling means). An advantage of mechanical connectors which are provided on chords or booms is that the additional cost of the formwork is minimal or nil because the additional resistance to separation of neighboring marginal portions can be offered by such chords or booms.

The improved coupling means with one or more sets of magnets can be used with particular advantage in formworks wherein the marginal portions of neighboring forms must be attracted to each other with a relatively small force. If the marginal portions are to resist larger separating forces, the number and/or dimensions of the magnets are increased and/or the coupling means then further includes mechanical connectors. Relatively large separating forces can be resisted by two sets of magnets, one set on each of two neighboring marginal portions. German Offenlegungsschrift No. 23 23 797 discloses magnets for retention of parts which are to be embedded in concrete, i.e., this publication does not disclose the possibility and/or advisability of separably coupling forms which are to be assembled into a formwork by means of permanent magnets, electromagnets or combinations of permanent magnets and electromagnets.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A formwork for cementitious materials, comprising at least two substantially aligned forms disposed end to end and jointly forming a larger form and having neighboring marginal portions; and means for separably coupling said marginal portions to each other, said coupling means including magnets.

2. The formwork of claim 1, wherein said coupling means further comprises interfitted complementary male and female detent means provided on said marginal portions.

3. The formwork of claim 2, wherein said marginal portions are elongated and said detent means are arranged to oppose movements of said forms relative to each other in the longitudinal direction of said marginal portions.

4. The formwork of claim 3, wherein said magnets are arranged to oppose movements of said marginal portions away from each other.

5. The formwork of claim 2, wherein said detent means include tongue and groove connections.

6. The formwork of claim 1, wherein said coupling means further comprises means for mechanically fastening said marginal portions to each other.

7. The formwork of claim 6, wherein said fastening means includes chords.

8. The formwork of claim 1, wherein at least some of said magnets are recessed into at least one of said marginal portions.

9. The formwork of claim 1, further comprising means for separably connecting at least some of said magnets to at least one of said marginal portions.

10. The formwork of claim 1, wherein said magnets include a set of magnets having a first polarity and being provided on one of said marginal portions and a set of magnets having an opposite second polarity and being provided on the other of said marginal portions to attract the magnets of said first set.

11. The formwork of claim 1, wherein said magnets are provided on at least one of said marginal portions and the coupling means further comprises ferromagnetic components provided on the other of said marginal portions adjacent said magnets.

12. The formwork of claim 1, wherein said magnets form part of at least one of said marginal portions and the other of said marginal portions includes at least one magnet having a polarity opposite that of the magnets of said one marginal portion.

13. The formwork of claim 1, wherein one of said marginal portions has recesses for said magnets and the other of said marginal portions includes a substantially straight ferromagnetic component which is attracted by said magnets.

14. The formwork of claim 1, further comprising means for separably fastening said magnets to at least one of said marginal portions.

15. The formwork of claim 14, wherein said fastening means include clips and said one marginal portion has recesses for at least some of said magnets.

16. The formwork of claim 1, wherein each of said forms has a front side which is in contact with concrete when the formwork is in use and a rear side, and further comprising additional magnets provided at the rear side of at least one of said forms.

17. The formwork of claim 1, wherein at least one of said marginal portions includes means for facilitating mechanical connection of said marginal portions to each other in addition to the coupling action of said magnets.

18. The formwork of claim 1, wherein said magnets form part of at least one of said marginal portions and the other of said marginal portions includes at least one ferromagnetic component which is attracted by the magnets of said one marginal portion.

* * * * *